United States Patent [19]

Lenhardt

[11] Patent Number: 4,578,954

[45] Date of Patent: Apr. 1, 1986

[54] MEANS FOR DEGASSIFYING AND SUPERHEATING HOTWELL CONDENSATE IN A RECYCLING STEAM SYSTEM

[75] Inventor: Michael J. Lenhardt, Trenton, N.J.

[73] Assignee: Transamerica DeLaval Inc., Princeton, N.J.

[21] Appl. No.: 715,407

[22] Filed: Mar. 25, 1985

[51] Int. Cl.[4] ..... F01K 7/34

[52] U.S. Cl. ..... 60/691; 60/646; 60/657

[58] Field of Search ..... 60/646, 654, 656, 657, 60/685, 688, 691, 692

[56] References Cited

U.S. PATENT DOCUMENTS 1,548,585 8/1925 Drysdale et al. ..... 60/688 X 4,391,101 7/1983 Labbe et al. ..... 60/646

FOREIGN PATENT DOCUMENTS 1929469 12/1970 Fed. Rep. of Germany ..... 60/646

*Primary Examiner*—Stephen F. Husar

*Attorney, Agent, or Firm*—Hopgood, Calimafde, Kalil, Blaustein & Judlowe

[57] ABSTRACT

In a recycling steam system, a flow of waste steam is retrieved from the power cycle at a pressure in excess of condenser pressure and directs this waste-steam flow into a network of pipes vertically suspended in and distributed throughout the hotwell condensate, the pipes being so vertically elongate and so perforated within the region of condensate immersion that differences between instantaneous waste-steam pressure and instantaneous condenser pressure are automatically accommodated, in the form of greater or lesser scrubbing discharges of the waste steam into the accumulated volume of condensate which serves the condensate-return part of the system.

11 Claims, 4 Drawing Figures

MEANS FOR DEGASSIFYING AND SUPERHEATING HOTWELL CONDENSATE IN A RECYCLING STEAM SYSTEM

BACKGROUND OF THE INVENTION

The invention relates to a recycling steam system and in particular to means for improving the quality of return condensate supplied to the steam generator of the system.

A typical steam system of the character indicated includes a turbine exhausting to a surface condenser, wherein condensate accumulates in the hot well of the condenser, prior to return as recycled feedwater to the steam generator, there being heater and pump means in the return line to serve the feedwater requirements of the steam generator. Make-up water, seal leakage at sub-atmospheric pressure zones of the power cycle are among sources of uncondensable gases, such as oxygen, dissolved in the condensate, and other non-condensable gases are released by water-treatment chemicals. Such non-condensable gases, particularly the oxygen, are corrosive on mechanical parts of the system.

The problem is particularly pronounced at system start-up, when water in the condenser is saturated with oxygen (air), and it is conventional to adopt a recirculation procedure relying on the condenser-vacuum deaerator, or a separate deaerator, or a chemical scavenger, to remove or reduce the oxygen content of condenser water, prior to starting the steam generator and its feedwater supply. And when the steam-power cycle is in full operation, the condenser vacuum (ejector) pump will serve a scavenging function, removing some but not all of the dissolved gases.

BRIEF STATEMENT OF THE INVENTION

It is an object of the invention to provide an improved method and means of degassifying condensate in a steam system of the character indicated, prior to its recycling return as feedwater to the steam generator.

Another object is to achieve the above object using energy which would otherwise be wasted heat energy rejected from the power cycle to the heat sink.

A specific object is to meet the above objects by so treating condensate of a continuously operating surface condenser that condensate returned to the power cycle from the condenser hotwell is at a temperature substantially above the saturation temperature corresponding to the condenser operating pressure.

Another specific object is to achieve the above objects in a manner which can be applied equally well either as a retrofit of existing surface condensers or as an initial-design feature of new-construction surface condensers.

A further specific object is to meet the immediately preceding object (a) without addition of special pressure chambers or separate pressure sections to the condenser hotwell and (b) without increasing the condenser-hotwell space requirement over that normally allowed in a surface condenser which serves a power cycle.

A general object is to meet the above objects with inherently safe and self-regulating structure, with minimum requirement for fail-safe controls and instrumentation.

The invention achieves the foregoing objects and further features by retrieving a flow of waste steam from the power cycle at a pressure in excess of condenser pressure and directing this waste-steam flow into a network of pipes vertically suspended in and distributed throughout the hotwell condensate, the pipes being so vertically elongate and so perforated within the region of condensate immersion that differences between instantaneous waste-steam pressure and instantaneous condenser pressure are automatically accommodated, in the form of greater or lesser scrubbing discharges of the waste steam into the accumulated volume of condensate which serves the condensate-return part of the system.

DETAILED DESCRIPTION

A preferred embodiment of the invention will be described in detail in conjunction with the accompanying drawings, in which.

Figure 1:
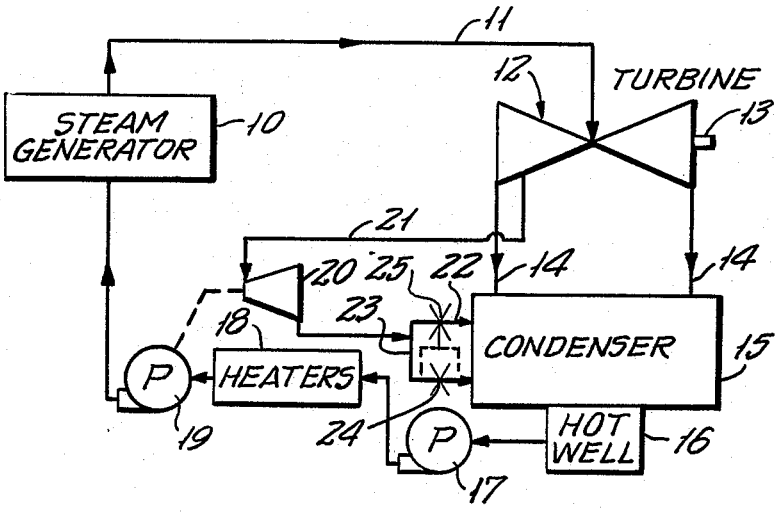
FIG. 1 is a simplified and schematic diagram of a recycling steam system to which the invention has been applied.

The invention will be described in the context of a power-plant steam system comprising a generator 10 of steam supplied in line 11 to a turbine 12 having an output shaft 13 and final-stage exhaust connections 14 to a surface condenser 15. Condensate is accumulated in a hotwell 16 and is the primary source of feedwater to generator 10; as shown, the recycling flow of feedwater is driven by a condensate pump 17 to suitable heaters 18, and by a feedwater pump 19, to generator 10. Typically, one or both of the pumps 17–19, as well as heaters 18 and other auxiliary devices (not shown) which operate in aid of the power cycle, rely on extraction-steam sources, as where heat is rejected at vents from reheaters or from drains within the system, and exhaust steam from such auxiliary devices is ultimately discharged into the condenser, which is the heat sink of the system. In FIG. 1, an auxiliary turbine 20 for driving the feedwater pump 19 is illustrative of such use of extraction steam, being shown to derive in line 21 a minor fraction of relatively low-pressure steam from an intermediate stage drain of turbine 12; in a conventional system, exhaust from the auxiliary turbine 20 is discharged directly into the condenser 15, at an elevated connection 22, above the level of condensate in the hotwell 16.

In accordance with the invention, the exhaust flow of low-pressure steam from one or more extraction-steam utilization devices, such as the auxiliary turbine 20, or from some other source of low-pressure waste heat, is discharged directly into the volume of condensate in the hotwell 16. This discharge is via a distribution network comprising a matrix array of laterally spaced vertical pipes which are immersed in condensate; in FIG. 1, this distribution network is served by a branch line 23 having an orifice or throttle valve 24 whereby a given flow of steam can be assured into the network at a pressure which is above the pressure in the condenser. To assure this flow, a valve 25 in line 22 to the condenser responds to the pressure drop across orifice 24 to admit steam flow in line 22 only to the extent that the exhaust flow from turbine 20 is not required by the network supply line 23.

Figure 2:
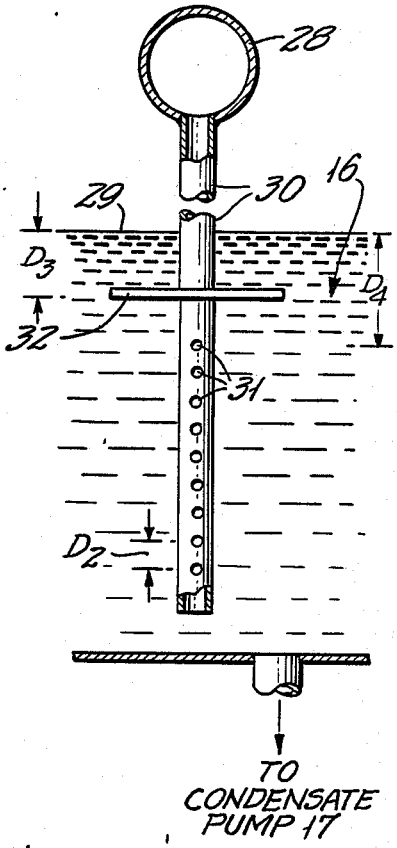
FIG. 2 is an enlarged fragmentary view in elevation of an elemental component of the invention, being contained within part of the system of FIG. 1.
Figure 3:
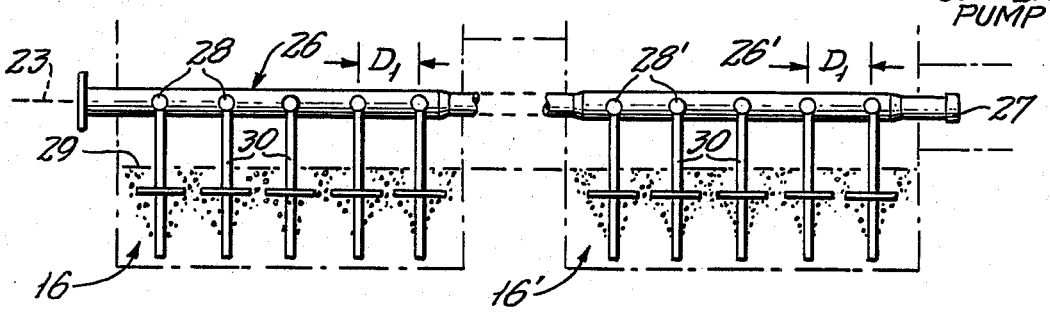
FIGS. 3 and 4 are, respectively, views in elevation and in plan for a network array of the elemental component of FIG. 2.
Figure 4:
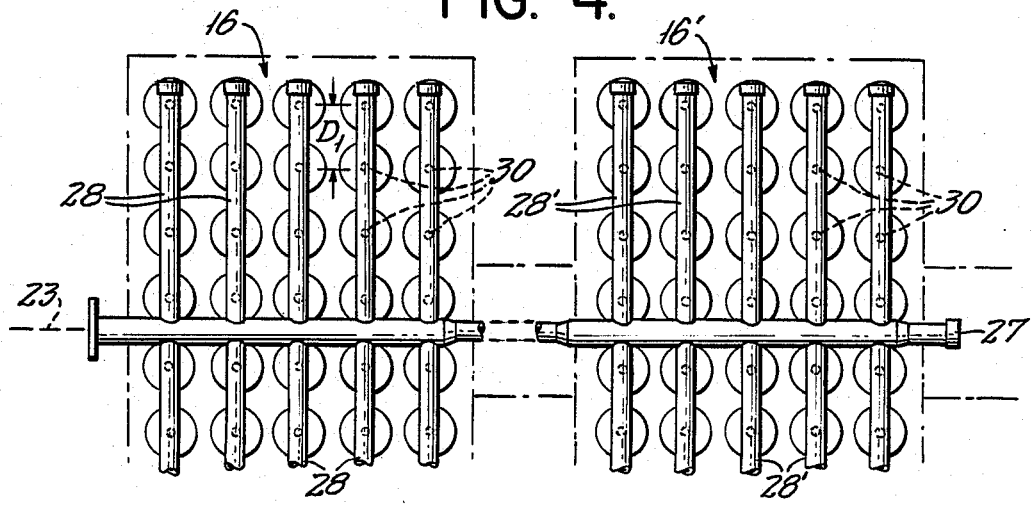

FIGS. 3 and 4 respectively show in elevation and in plan a system of primary and secondary headers serving, from the branch connection 23, an arrayed plurality of discharge devices as depicted in FIG. 2. In FIGS. 3 and 4, the connection 23 serves a first primary header 26 over a first hot-well reservoir 16, and header 26 is seriesconnected to a second primary header 26' over a second hot-well reservoir 16'; and header 26' is capped at 27. Secondary headers 28 branch in opposite directions from locations at uniform spacings $D_1$ along the primary header 26, being capped at their outer ends; and a similar array of capped secondary headers 28' is associated with the second primary header 26'. The phantom lines in FIGS. 3 and 4 will be understood to indicate support of the distribution headers from wall structure of the condenser and its hotwell (or wells) at an elevation which is always above the upper surface 29 of the condensate.

Individual discharge pipes 30 are suspended vertically from locations along each of the secondary headers 28 (28'), preferably at the spacing $D_1$, so that pipes 30 collectively serve for discharge of exhaust steam (from auxiliary turbine 20) directly into and with substantially uniform matrix distribution within substantially the entire volume of hot-well accumulated condensate. In FIG. 2, each element 30 of such discharge is seen as an open-ended straight pipe served by its supporting header 28 and having a vertically distributed plurality of lateral discharge openings 31, at uniform spacings $D_2$ immersed below the condensate surface 29. Preferably, a circular flange or baffle 32 is mounted to each pipe 30 above the uppermost level of openings 31 and at a predetermined immersion depth $D_3$. At each immersion depth of openings 31, it is preferred that there be an angularly spaced plurality of openings 31, so that each opening 31 that is visible in FIG. 2 will be understood to be one of each such angularly spaced plurality, suitably pluralities of four.

The orifice(24)-regulated delivery of auxiliary turbine exhaust steam to the described system of distribution to pipes 30 should be set to assure a range of pressures above instantaneous condenser pressure, such that condensate will not rise in pipes 30 enough to flood the uppermost discharge openings 31. Such a setting will be understood at all times to allow header-supplied steam to discharge at least at a minimum depth $D_4$ of condensate immersion, with rising steam bubbles temporarily retained and laterally deflected by each baffle 32, thus allowing a minimum action of scrubbing the condensate as well as superheating (boiling) the condensate, i.e., heating the condensate above the normal operating temperature of the condensate. For steam pressure in pipes 30 above this minimum (in relation to condenser pressure), the condensate will be less able to rise in pipes 30, so that successively lower levels of openings 31 become availabile for steam discharge into the condensate, with of course greater heating and scrubbing action on the condensate. At a still greater steam pressure in pipes 30 (in relation to condenser pressure), no condensate will rise in pipes 30, and steam will discharge at all openings 31; beyond this condition, nothing is served by blowing excess steam out the lower open ends of pipes 30, and thus the pressure drop which governs valve 25 should be set to then be opening valve 25 so as to divert the excess steam directly into the condenser at port 22.

Operation of the described condensate heating and scrubbing structure will be better appreciated from the proportions of illustrative dimensions, for the case of wells 16 (16') which are about 25 by 40 feet in horizontal area, with condensate accumulation in the range of 3 to 5 feet deep. The individual discharge pipes 30 may be constructed from standard 4-inch diameter pipe, immersed in condensate to a depth which is about six inches from the bottom, and at pipe spacings $D_1$ of four feet. Openings 31 may be drilled, ½-inch diameter, and at four equal angular spacings at each elevation, there being a two-inch vertical space $D_2$ between openings 31 of successive levels. The immersion depth $D_4$ between openings 31 may be about 10 inches below surface 29, and baffle 32 may be of 20-inch diameter and immersed to a depth $D_3$ of 6 to 8 inches. The secondary headers 28 (28') may be of 10-inch diameter, and the primary headers 26 (26') of 36-inch diameter.

The described invention will be seen to achieve all stated objects. The low-pressure waste-heat steam supplied to the matrix of discharge pipes boils the condensate, thereby driving non-condensable gases out of the condensate, for scavenging via the ejector mechanism of the existing (conventional) condenser 15. The particular design will return condensate to the power cycle at a temperature 7 to 12° F. above the saturation temperature corresponding to the condenser operating pressure while using as much as needed of the total exhaust flow from the feedpump turbine 20. This exhaust will "float" at a pressure 2.5 to 3.0-inches Hg above the main turbine exhaust pressure in lines 14, provided that the hotwell level 29 is maintained. If this level is raised, the degree of condensate superheat will increase and the exhaust pressure from the feed-pump turbine 20 will increase; if the level is dropped, similar but oppositely directed effects will occur. At reduced load, when the available quantity of turbine (20) exhaust steam drops, the degree of superheat of the condensate will drop and the "float" differential pressure will also drop.

While the invention has been described in detail for an illustrative embodiment, it will be understood that modifications may be made without departing from the scope of the invention. For example, in periods when the turbine (20) exhaust may not be available, other sources of waste-heat steam may be used for operation of the described condensate scrubbing and heating structure.

What is claimed is:

1. In a feedwater-recovering steam-generating power system wherein a turbine is the means of utilizing generated steam for development of output power, wherein turbine exhaust discharges to a condenser having a hot well providing a source of recycling feedwater, wherein a feedwater pump is connected to recycle condensate from the hot well to the steam generator, and wherein a low-pressure source of waste steam exists within the system, the low pressure of such waste steam being in excess of the operating pressure within the condenser, the improvement in which an upstanding pipe is suspended within the hot well over a range of immersion depths in hotwell condensate, the wall of said pipe having a distributed plurality of discharge openings as a function of immersion depth, and the upper end of said pipe being connected to the source of waste steam.

2. The improvement of claim 1, in which said pipe is open at its lower end, whereby condensate may freely seek its level within the pipe as a function of the instantaneous pressure difference between waste-steam pressure and condenser pressure.

3. The improvement of claim 1, in which said pipe is one of a distributed plurality of pipes laterally spaced from each other and having openings below the normal water level in the hot well, and header means serving the plurality of pipes and connecting said plurality to the waste steam source.

4. The improvement of claim 1, in which the waste-steam source is the exhaust of an auxiliary steam turbine connected to drive the feedwater pump.

5. The improvement of claim 1, in which a circumferential baffle extends radially outwardly from said pipe at an elevation which is below normal condensate level in the hot well and which is above the uppermost one of said discharge openings.

6. The method of degassifying feedwater recycled by a pump to a steam generator from the hot well of a steam condenser which receives exhaust steam from a multi-stage turbine that is driven by steam from said generator, which method comprises tapping a flow of low-pressure extraction steam from the turbine at an intermediate stage short of the final stage of turbine exhaust to the condenser, using the tapped flow to drive the feedwater pump and to develop a flow of pump-drive exhaust steam at a pressure exceeding condenser-operating pressure, and discharging said flow of pump-drive exhaust steam into the body of hot-well accumulated condensate at a distributed plurality of discharge locations within the body of said accumulated condensate.

7. The method of degassifying feedwater recycled from the hotwell of a steam condenser in a power cycle having at least one source of low-pressure waste steam which would ordinarily be returned to the condenser, which method comprises directing a flow of waste steam from said source to a distributed plurality of discharge locations within the volume of condensate in the hotwell.

8. The method of claim 7, in which the plural discharge locations involve a distributed plurality of depths within the body of accumulated condensate.

9. The method of claim 7, in which the plural discharge locations involve a vertically and horizontally distributed plurality within the body of accumulated condensate.

10. The method of claim 7, wherein the flow of waste steam is in excess of that required to substantially cover the volume of condensate, which method includes the additional step of directing the excess flow of waste steam for discharge into the condenser.

11. The improvement of claim 3, wherein the flow of waste steam from said source is in excess of that required to substantially cover the volume of condensate in the hotwell, and wherein automatic means including an element in the waste-heat connection to said plurality of pipes is responsive to the existence of such excess flow to divert the excess flow to said condenser.

* * * * *